US006183383B1

(12) United States Patent
McSorley

(10) Patent No.: US 6,183,383 B1
(45) Date of Patent: Feb. 6, 2001

(54) PAD FOR A HOCKEY STICK BLADE

(75) Inventor: Chris McSorley, Las Vegas, NV (US)

(73) Assignee: Tacki-Mac Grips, Inc., Las Vegas, NV (US)

( * ) Notice: Under 35 U.S.C. 154(b), the term of this patent shall be extended for 0 days.

(21) Appl. No.: 09/156,558

(22) Filed: Sep. 17, 1998

Related U.S. Application Data

(63) Continuation of application No. 08/855,885, filed on May 14, 1997, now abandoned.

(51) Int. Cl.[7] ..... A63B 59/14
(52) U.S. Cl. ..... 473/563
(58) Field of Search ..... 473/560–563

(56) References Cited

U.S. PATENT DOCUMENTS

| | | |
|---|---|---|
| 2,912,245 | 11/1959 | Gardner et al. . |
| 5,127,649 | 7/1992 | Carbonero . |
| 5,558,326 | 9/1996 | Adamson et al. . |
| 5,603,498 | 2/1997 | Crawford et al. . |

*Primary Examiner*—Mark S. Graham
(74) *Attorney, Agent, or Firm*—Quirk & Tratos

(57) ABSTRACT

A pad for the blade of hockey sticks is provided which includes an elastic body having a plurality of ridges and knobs for contacting the puck or ball and controlling the same. A self-adhesive layer is provided for adhering the pad to the blade of the stick.

9 Claims, 1 Drawing Sheet

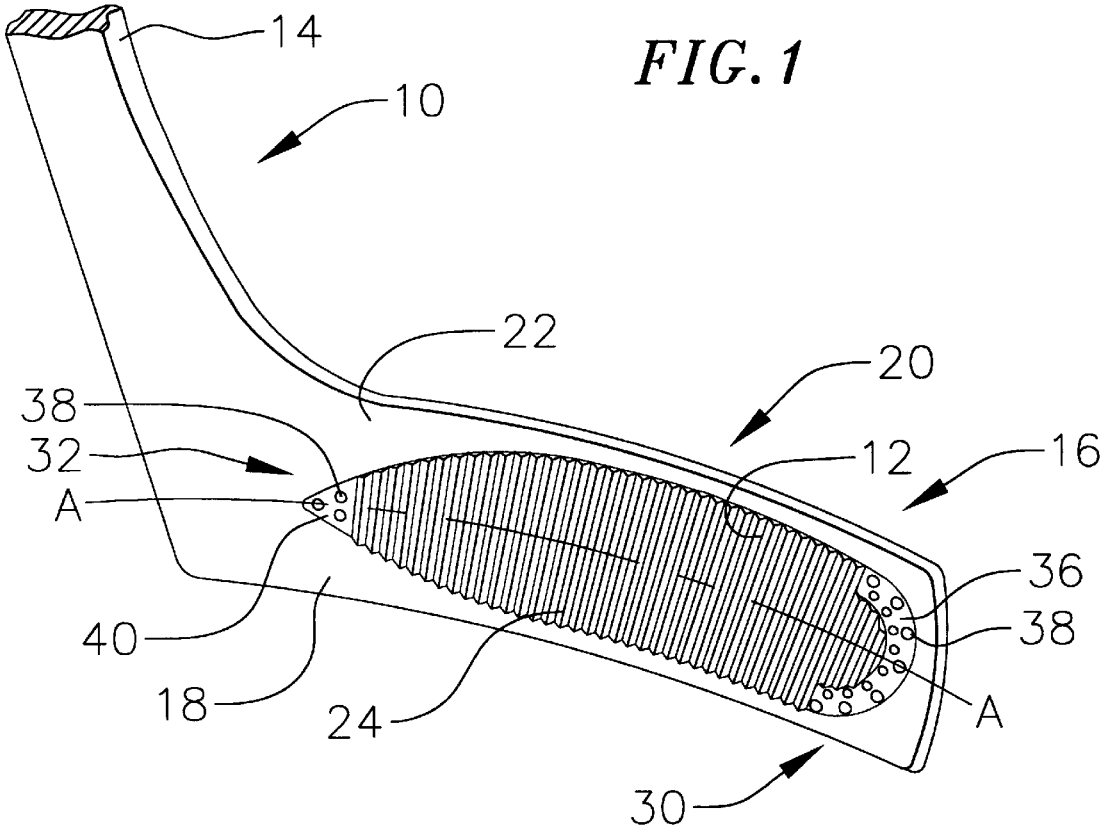
FIG. 1
FIG. 2
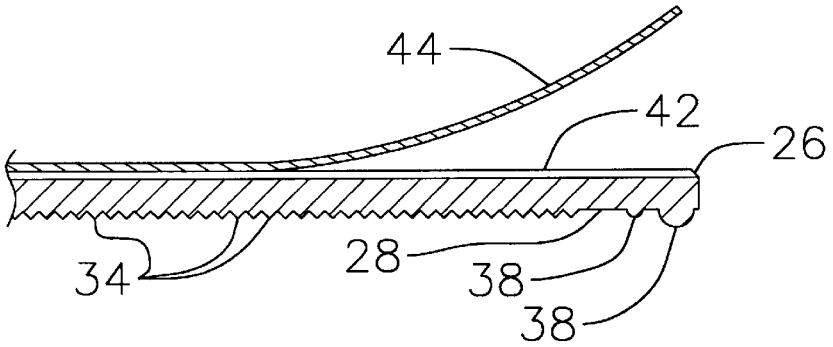

PAD FOR A HOCKEY STICK BLADE

This application is a continuation of U.S. patent application Ser. No. 08/855,885 filed May 14, 1997 abandoned.

FIELD OF THE INVENTION

The present invention relates to ice and roller hockey sticks and more particularly to coverings for the blades of such sticks.

BACKGROUND OF THE INVENTION

In the sport of ice hockey, sticks are used to pass, handle, carry and shoot a hard rubber puck. These sticks are often entirely fabricated from a hard wood such as ash having an elongated handle terminating at a thin, elongated and somewhat rectangular stick blade. Modernly, some players use an aluminum handle mounting at the end thereof a wooden blade. The blade defines a forehand and a backhand face for contacting the puck used in playing the game. As is known, the blade may be curved to a degree permitted by the rules to help control the puck.

To protect the wooden blade and to act to somewhat conceal the puck, it is known for players to wrap the hockey stick blade with a black adhesive tape. The black tape acts to conceal the black puck when it is positioned thereagainst.

In a like manner, in roller hockey played on in-line skates, similar sticks are used and are fabricated from wood, plastic or a combination thereof. Again these sticks are used to pass, handle, carry and shoot the plastic puck or ball. As in ice hockey, it is known for roller hockey players to wrap the blades of their stick with tape.

A drawback with wrapping the blades of hockey sticks is that the wrapping can unravel which is particularly frustrating during the play of the game. Furthermore wrapping the stick is time consuming. Further, the tape used in wrapping the hockey stick blades, often does not provide a consistent co-efficient of friction for engagement of the puck or ball. It would be useful to provide a device which is easy to apply to the blade of a hockey stick and which provides a durable, absorbent and high co-efficient of friction surface for the hockey stick blade.

SUMMARY OF THE INVENTION

There is, therefore, provided according to the present invention a pad for the blade of hockey stick which overcomes the problems and drawbacks noted above.

The pad for the hockey stick includes an elastic body having a longitudinal and lateral dimension, inside and outside surfaces and forward and rear ends. Means are provided for adhering the body inside surface to a selected face or both faces of the hockey stick blade. When so adhered, the longitudinal and lateral dimensions correspond to the like dimensions for the hockey stick blade. The body includes a plurality of ridges extending across the body outside surface, these ridges and the material of the elastic body cooperating to provide a durable, high co-efficient of friction surface for engagement with the hockey puck or ball.

In further embodiments, a plurality of projecting knobs are provided on the body proximate the forward and/or rear ends of the elastic body to further provide for control of the puck or ball.

It has been found that by providing the elastic body made from a material such as Krayton®, control of the puck or ball is enhanced. Furthermore, the elastic and resilient surface provided by the pad reduces the sound of the puck or ball striking the hockey stick blade making it difficult for opposing team members to follow the play.

BRIEF DESCRIPTION OF THE DRAWINGS

These and other features and advantages will become better appreciated with reference to the specification, claims and drawings wherein:

FIG. 1 is a front top perspective view of a blade of a hockey stick with a pad according to the present invention attached thereto; and FIG. 2 is a partial section view of the pad of FIG. 1 illustrating the means for adhering the pad to the blade.

DESCRIPTION

Turning to the drawings, FIG. 1 shows a portion of a hockey stick 10 using a blade pad 12 according to the present invention. As is well known, the hockey stick 10 has an elongated handle 14 which terminates at a hockey stick blade 16 shown as generally thin, elongated and rectangular. The hockey stick blade 16 defines a forehand face 18 and, an opposite face defining the backhand face 20. The hockey stick 10 shown in FIG. 1 is for a left hand dominant player in that, looking down the stick 10, the forehand face 18 is on the right side of the blade 16 and the backhand face 20 is on the left side. Each of the forehand and backhand faces 18, 20 define a generally rectangular area 22 for contacting the puck or ball used in playing the game.

As shown in FIG. 1, the stick 10 is provided with a pad 12 according to the present invention. The pad 12 is defined by an elastic body 24 having a longitudinal dimension aligned with a longitudinal axis A as shown in FIG. 1 and a transverse lateral dimension. The body 24 is thin defining an inside and outside surfaces 26, 28 and forward and rear ends 30 and 32 respectively. As is seen, the lateral and longitudinal dimensions of the body 24 are such as to correspond with and occupy substantially the area 22 for engagement with the puck or ball.

With continued reference to FIGS. 1 and 2, the body 24 includes on the outside surface 28 a plurality of ridges 34 which, preferably, extend in a lateral direction over the length of the body 24. Where the body 24 has a thickness of approximately 1/32 of an inch, these ridges may extend 1/64 of an inch above the outside surface 28 of the body 24. Further, where the longitudinal length of the body 24 is 8¼ inches, these ridges 34 may be spaced 1/32 inches on center. Of course it is to be understood that the ridges 34 may extend in any direction over the outside surface of the body 24 and may have any suitable spacing or size.

The forward end 30 of the body 24 is preferably semi-circular defining an arcuate zone 36 generally free of the ridges 34. In this zone 36, the body 24 is planar having thereon a plurality of outwardly projecting, hemispherical knobs 38. As best shown in FIG. 1, these knobs 38 are spaced along and are concentric with the semi-circular contour of the zone 36. The knobs 38 may project 1/32 of an inch from the body 24.

Opposite the forward end, the rear end 32 includes a triangular tip 40 also free of the ridges 34 as shown in FIG. 1. Similarly, semi-spherical knobs 38 are disposed at the tip 40.

To attach the pad 12 to the hockey stick blade 16, suitable means are provided. With reference to FIG. 2, these means may be by providing an adhesive layer 42 over the inside surface of the pad 12. A non-adhering and removable, plastic or paper cover 44 is provided over the adhesive layer 42. When the user desires to attach the pad 12 to the hockey stick blade 16, the cover 44 is removed revealing the adhesive layer 42. The inside surface 26 having the adhesive layer 42 is then pressed in the proper position onto either or both the forehand and backhand faces 18, 20 of the hockey stick blade 16.

It has been found that by providing the pad 12, preferably manufactured from Krayton®, that a durable surface is provided for the hockey stick blade 16. Furthermore, the ridges, knobs and overall elastic properties of the pad 12 provide a high co-efficient of friction to enhance control of a puck or ball positioned against the pad 12. In this fashion, the player may be able to obtain better control over the puck or ball. Still further, the ridges and knobs in the overall elastic properties of the pad 12, deaden the sound of the puck or ball as it strikes the hockey stick blade 16 as when receiving a pass thereby making it difficult for players on the opposing team to follow the puck or ball by sound. Still further, for the ball used in roller hockey, it has been found that the pad 12 can be useful to impart spin onto the ball during a shot to confuse the other team and particularly their goalkeeper. Still further, the pad 12 is not subject to unraveling from the stick as would be a wrapped material such as tape.

As stated above, while the pad 12 is preferably in the shape as shown in the drawings and described above, it can have any suitable shape corresponding to the area 22 or portions thereof of the hockey stick blade 16.

While I have shown and described certain embodiments of the present invention it is to be understood that it is subject to many modifications and changes without departing from the spirit and scope of the appended claims.

I claim:

1. A pad for the blade of a hockey stick, said blade having forehand and backhand faces, comprising:

an elastic body having a longitudinal and a lateral dimension, inside and outside surfaces and forward and rear ends, the forward end being semi-circular and including proximate the forward end a plurality of projecting knobs:

means adapted for adhering the body inside surface to a selected face of the blade, said longitudinal and lateral dimensions corresponding to like dimensions for the face; and a plurality of ridges extending across the body outside surface.

2. The pad of claim 1 wherein said knobs are disposed in a semi-circular pattern coextensive with said forward end.

3. A pad for the blade of a hockey stick, said blade having forehand and backhand faces, comprising:

an elastic body having a longitudinal and a lateral dimension, inside and outside surfaces and forward and rear ends and wherein the body rear end tapers to a tip and includes a plurality of projecting knobs proximate said tip;

means adapted for adhering the body inside surface to a selected face of the blade, said longitudinal and lateral dimensions corresponding to like dimensions for the face; and a plurality of ridges extending across the body outside surface.

4. A pad for the blade of a hockey stick, said blade having forehand and backhand faces, said pad comprising:

an elastic body having a longitudinal and a lateral dimension, inside and outside surfaces and forward and rear ends, said forward end rounded and said body tapering to a tip at said rear end:

means adapted for adhering the body inside surface to a selected face of the blade, said longitudinal and lateral dimensions corresponding to like dimensions for the face;

a plurality of ridges extending laterally across the body outside surface; and a plurality of projecting knobs at each of the forward and rear ends.

5. The pad of claim 4 wherein said knobs at the forward end are in a pattern corresponding to said rounded end.

6. The pad of claim 5 wherein the forward end is semi-circular.

7. The pad of claim 4 wherein the knobs at the rear end are in a triangular pattern.

8. The pad of claim 4 wherein said body has a thickness dimension of approximately 1/32 inches.

9. The pad of claim 8 wherein the knobs project approximately 1/32 inches from said body.

* * * * *